US005469121A

United States Patent [19]

Payet-Burin

[11] Patent Number: 5,469,121

[45] Date of Patent: Nov. 21, 1995

[54] MULTIPLE CURRENT-LIMITING CIRCUIT BREAKER WITH ELECTRODYNAMIC REPULSION

[75] Inventor: Jean-Luc Payet-Burin, Voreppe, France

[73] Assignee: Merlin Gerin, France

[21] Appl. No.: 216,051

[22] Filed: Mar. 21, 1994

[30] Foreign Application Priority Data

Apr. 7, 1993 [FR] France ..... 9304298

[51] Int. Cl.[6] ..... H01H 75/00

[52] U.S. Cl. ..... 335/16; 335/8; 218/22

[58] Field of Search ..... 335/8–10, 167, 335/76, 16, 147, 195, 202; 200/147 R

[56] References Cited

U.S. PATENT DOCUMENTS 4,480,242 10/1984 Castonguay et al. .
4,714,907 12/1987 Bartolo et al. .
4,745,384 5/1988 Toda et al. .
4,782,583 11/1988 Castonguay et al. ..... 335/16
4,845,459 7/1989 Manthe et al. ..... 335/195
5,073,764 12/1991 Takahashi et al. ..... 335/16

FOREIGN PATENT DOCUMENTS 0232637 8/1987 European Pat. Off. .
2553930 4/1985 France .
2602091 1/1988 France .
8428351 5/1985 Germany .

*Primary Examiner*—Lincoln Donovan
*Attorney, Agent, or Firm*—Parkhurst, Wendel & Rossi

[57] ABSTRACT

A multipole circuit breaker having a movable contact for each pole, the movable contact being biased by a spirally-wound spring including a feeler part which slides on a bearing surface of the movable contact to modify the application point of a pressure force P in a second active repulsion position, resulting in a decrease of the restoring torque before operation of the mechanism. The movable contact is forked-shaped and is articulated on an eccentric spindle parallel to the rotation axis of the bar. The spirally-wound spring is mounted to float in the recess of the bar, and comprises two helicoidal wire windings.

6 Claims, 4 Drawing Sheets

FIG. 1
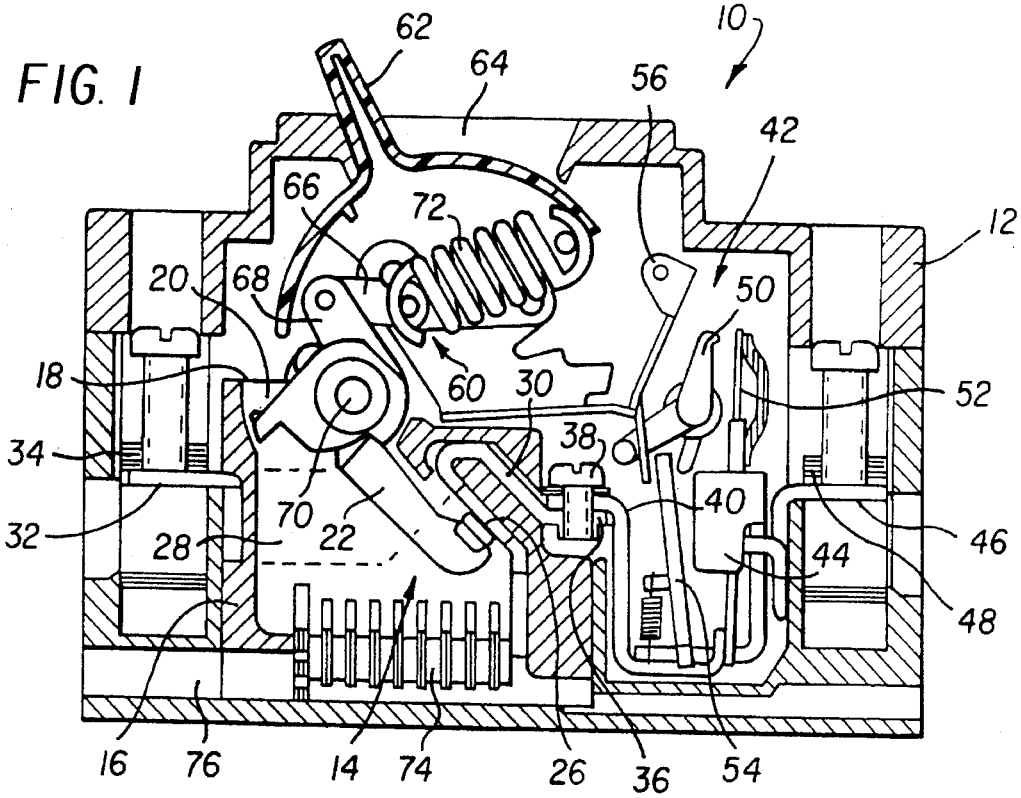
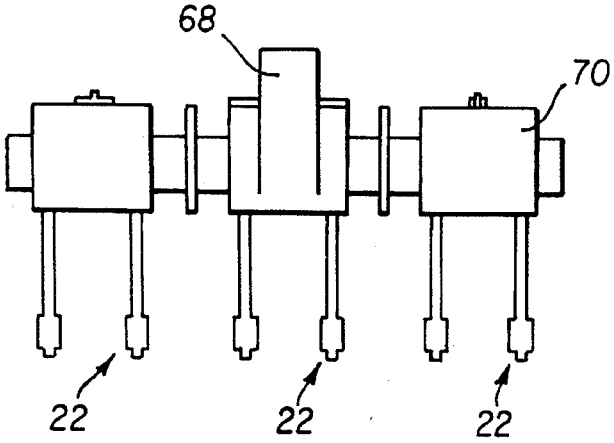
FIG. 2
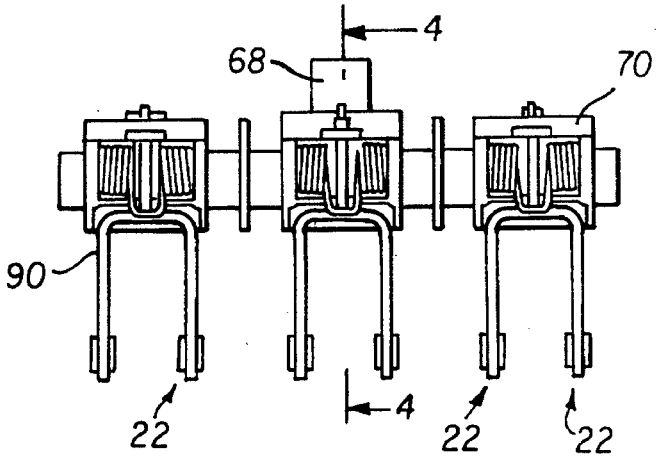
FIG. 3

MULTIPLE CURRENT-LIMITING CIRCUIT BREAKER WITH ELECTRODYNAMIC REPULSION

BACKGROUND OF THE INVENTION

The invention relates to a multipole current-limiting circuit breaker with molded insulating case, housing:

a current interrupting device having per pole contact elements separable by electrodynamic repulsion, and at least one arc extinguishing chamber, an operating mechanism having a toggle associated with a connecting spring, and with a trip device, a switching bar made of insulating material acting as support for the movable contacts of all the poles, said bar being mechanically coupled to the toggle to be moved by the mechanism between the closed position and the open position of the contacts, a handle coupled to the mechanism and passing through an aperture in the front panel of the case, the movable contact of each pole being formed by a contact arm articulated on a spindle securedly united to the bar, said movable contact being able to be moved by electrodynamic repulsion from a first rest position to a second active position, and the spindle of the movable contact being eccentric with respect to the rotation axis of the bar, and flexible means comprising a spring housed in a recess of the bar to provide the contact pressure and to slow down the drop-back of the movable contact to the first rest position, the spring sliding on a bearing surface of the movable contact to modify the application point of the pressure force P in the course of the opening travel.

In this first type of current-limiting circuit breaker, the occurrence of a short-circuit causes in a first phase high-speed opening, by electrodynamic repulsion, of the contacts of the faulty pole, and in a second phase tripping of the mechanism controlled by the tripping means. Rotation of the switching bar for final opening of the contacts takes place only during the second phase after the trip lever has been unlocked by the latch.

The arm remains immobile during the first electrodynamic repulsion phase.

Only the contact arm of the faulty pole opens, the contacts of the other poles remaining closed during this first phase. It is essential that rotation of the bar for confirmation of opening of the circuit breaker take place before the contact arm drops back to the closed position. The coordination defect between the two phases is mainly due to the bar being held in the closed position during the first repulsion phase and may cause contact chatter and premature wear of the circuit breaker.

According to U.S. Pat. No. 4,480,242, the movable contact is subjected to a variation of the contact pressure spring restoring torque, said torque being increasing up to an intermediate position of the opening travel, then decreasing up to the open position.

The document FR-A-2,553,930 filed by the applicant belongs to a second type of current-limiting circuit breaker having a reversible mechanism, in which the rotation spindle of the bar coincides with the articulation point of each contact arm. The drag spring is anchored between the movable contact and the bar.

The contact arm of each pole cooperates with the toggle device to drive the switching bar in rotation in the opening direction after the electrodynamic repulsion means of the faulty pole have come into action so as to enable separation of the contacts of all the poles before the trip lever is unlocked by the latch.

The reversibility of the mechanism by rotation of the bar during the first electrodynamic opening phase speeds up the tripping time to confirm final opening of the circuit breaker. Rotation of the bar before operation of the trip device is rendered possible due to the deformation of the toggle, the rods there having an offset angle between 10 and 20 degrees on the closed position.

SUMMARY OF THE INVENTION

The invention relates to the first type of current-limiting circuit breaker, and its object is to improve the drop-back prevention system of the movable contact at the end of repulsion travel.

The circuit breaker according to the invention is characterized in that:

the movable contact is shaped as a fork having a common body supporting two contact arms, and a securing shank articulated on the spindle and that the spirally-wound spring is mounted floating in the recess of the bar and comprises a feeler part cooperating with two balancing slots of the bearing surface securedly united to the body to distribute the contact pressure on the two contact arms.

The spirally-wound spring comprises two helicoidal windings made of wire arranged coaxially in the recess and interconnected in the center zone by a protruding flexible link forming said feeler, and comprising two end strands pressing against a wall of the bar.

Distribution of the contact pressure with the spirally-wound spring is achieved by means of two balancing slots provided on the bearing surface of the body of the fork-shaped movable contact. Each slot is provided with latching surfaces to temporarily block the movable contact in the second active position.

BRIEF DESCRIPTION OF THE DRAWINGS

Other advantages and features will become more clearly apparent from the following description of an illustrative embodiment of the invention, given as a non-restrictive example only and represented in the accompanying drawings, in which:

FIG. 1 is a schematic sectional view of a circuit breaker according to the invention, represented in the closed position;

FIG. 2 is an elevational view of the switching bar equipped with the movable contacts of all the poles, as viewed from the stationary contacts side;

FIG. 3 represents the bar of FIG. 2, as viewed from the opposite side;

DETAILED DESCRIPTION OF THE PREFERRED EMBODIMENT

Figure 4:
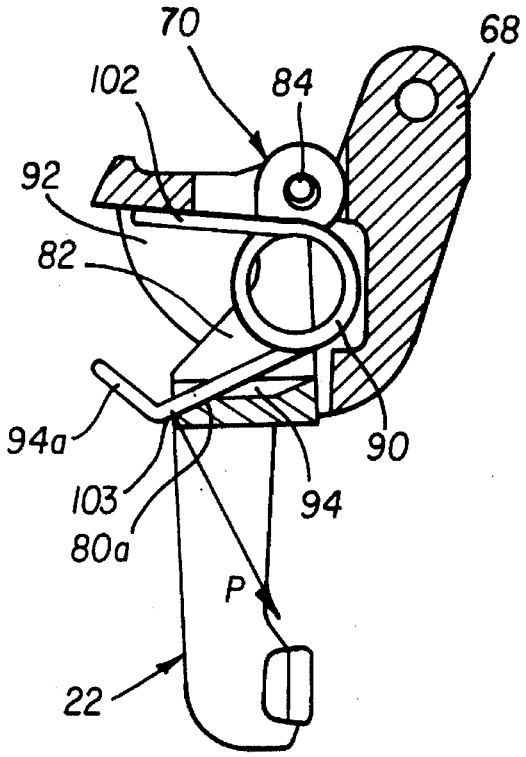
FIG. 4 shows a sectional view of the bar according to the line 4—4 of FIG. 3, the movable contact being in a first rest position.

In FIG. 1, a multipole circuit breaker 10 with molded insulating case 12 comprises a breaking module 14 per pole, formed by a monoblock cartridge 16 made of molded plastic material, and having the shape of a parallelepiped rectangle. The cartridge 16 comprises a front panel 18 having an orifice 20 for passage of the movable contact 22 therethrough, and the breaking module 14 comprises an electrodynamic contact repulsion device.

Inside the cartridge 16 there are located two stationary contacts 24, 26 respectively connected by connecting conductors 28, 30 to a first contact strip 32 of a connection terminal 34, and to a second contact strip 36 designed to be connected by a screw 38 to a third contact strip 40 of a trip device 42.

The trip device 42 comprises a magnetothermal trip device 44 equipped opposite from the contact strip 40 with a fourth contact strip 46 forming part of the other connection terminal 48 of the pole. The trip device 44 is electrically connected in series in the pole with the contacts 22, 24, 26 of the breaking module 14.

The trip device 42 comprises in addition a trip bar 50 mounted with limited rotation between a charged position and a tripped position according to the position of the actuating element of the trip device 44, for example the bimetal strip 52 or blade 54. The rotary bar 50 is moved to the tripped position as soon as the current flowing in the pole exceeds a preset threshold. The trip bar 50 moreover cooperates with a latch 56 of an operating mechanism 58 with toggle 60 and handle 62.

The mechanism 58 is common to all the poles, and is housed inside the case 12, only the handle 62 being accessible from outside passing through an aperture 64 arranged in the front panel of the case 12, for manual operation of the circuit breaker 10.

The lower rod 66 of the toggle 60 is coupled to a protuberance 68 of a switching bar 70 acting as support for the movable contacts 22 of all the poles. The switching bar 70 is made of insulating material and extends parallel to the trip bar 50 in the transverse direction of the poles.

An unlocking action of the trip bar 50 on the latch 56 releases the mechanism 58, which is discharged due to the expansion action of a connecting spring 72, resulting in movement by pivoting of the toggle 60, and rotation of the bar 70 to the open position of the contacts 22, 24, 26 of all the poles. The unlocking order of the latch 56 can come from the magnetothermal trip module 44, or from an auxiliary trip device, notably an undervoltage release MN, shunt release MX, differential trip device, etc.

Each breaking module 14 houses two arc extinguishing chambers, only one 74 of which is represented in FIG. 1, each chamber being in communication with an opening or channel 76 for the breaking gases to escape to the outside of the cartridge 16. Each arc extinguishing chamber 74 is formed by stacking of the deionization plates with V-shaped notches facing the movable contact 22.

In FIGS. 2 and 3, the switching bar 70 of a three-pole circuit breaker is equipped with three identical movable contacts 22, located at regular intervals along the transverse direction of the bar 70. Each movable contact 22 is in the shape of a fork with two parallel contact arms **22*a*, 22*b* cooperating in the closed position with the two stationary contacts 24, 26**.

The inside of the cartridge 16 of each breaking module 14 is subdivided by an intermediate insulating wall into two adjacent compartments, into which the two arms **22*a*, 22*b* of the fork-shaped movable contact 22 penetrate through the orifice 20, the movable contact 22 being positioned astride the wall when pivoting thereof takes place between the closed and open positions. The bar 70 is guided in rotation by bearings (not represented) provided in the cartridge 16 of the different breaking modules 14**.

Figure 5:
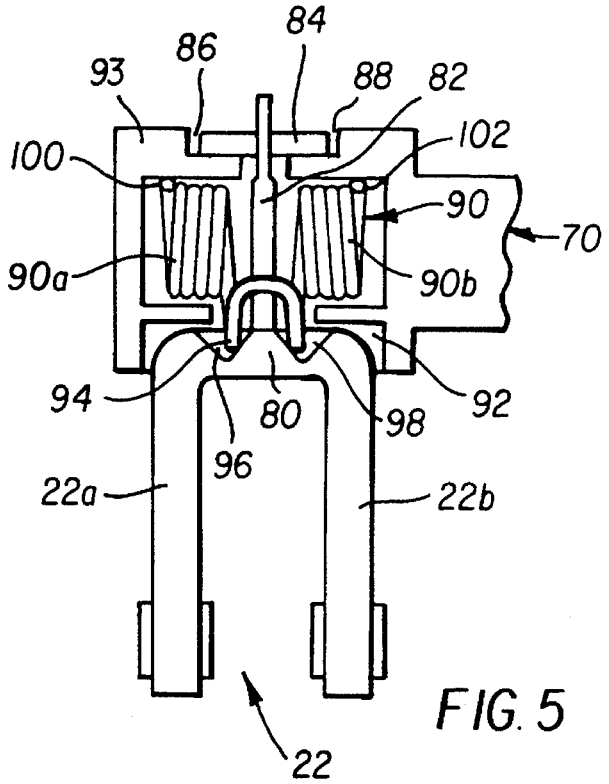
FIG. 5 represents a partial enlarged scale view of a pole of the bar of FIG. 3.
Figure 6:
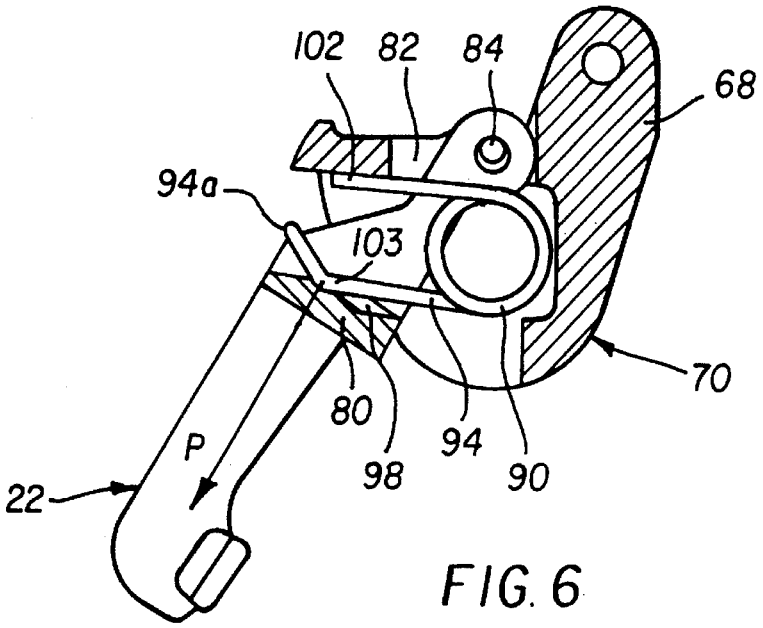
FIG. 6 is an identical view to FIG. 4, the movable contact being in a second active position after electrodynamic repulsion.

Referring to FIGS. 4 to 6, each fork-shaped movable contact 22 comprises a common base 80 supporting the two vertical contact arms **22*a*, 22*b*, so as to form a reversed U-shape. The straight base 80 extends in the transverse direction of the bar 70, and is equipped in the center zone with a securing shank 82 whose free end is articulated on a horizontal spindle 84 securedly united to the bar 70. The shank 82 is situated in the mid-plane of symmetry with a reverse orientation with respect to the two elementary contact arms 22*a*, 22*b***.

The spindle 84 of each movable contact 22 is housed with clearance in two aligned bearings 86, 88 arranged on the upper face of the bar 70. The contact spindle 84 is parallel and eccentric with respect to the rotation axis of the bar 70.

Each movable contact 22 cooperates with a spirally-wound spring 90 located in a recess 92 bounded by a rectangular frame 93 of the bar 70 to provide the contact pressure in the closed position. The spring 90 comprises two coaxial helicoidal windings **90*a*, 90*b*, made of wire and interconnected by a flexible intermediate link 94, through which the shank 82 passes bearing on the base of the movable contact 22. The flexible link 94 of the spring 90 comprises two strands of wire, shaped as a half-turn acting as feeler, and having an upwardly-curved protruding part 94*a***.

The feeler of the flexible link 94 is positioned in two V-shaped slots 96, 98 provided on the bearing surface **80*a* of the base 80 to ensure that the contact pressure is balanced in the closed position of the contacts 22, 24, 26. The two slots 96, 98 are symmetrical with respect to the mid-plane passing through the shank 82, and the two end strands 100, 102 of the two windings 90*a*, 90*b* are permanently pressed against the internal upper surface of the frame 93**.

The spring 90 is mounted floating in the recess 92 with respect to the axis of the rotary bar 70. Cooperation of the spring 90 with the base 80 of the fork-shaped movable contact 22 constitutes a device for temporary holding of the contact at the end of the electrodynamic repulsion travel.

Operation of a pole of the circuit breaker 10 with electrodynamic repulsion is as follows:

In the closed position represented in FIG. 1, the fork-shaped movable contact 22 is in a stable position bearing against the corresponding stationary contacts 24, 26. The symmetrical reaction of the two strands 100, 102 of the spirally-wound spring 90 on the frame 93 of the bar 70 ensures balancing of the contact pressure on the two arms **90*a*, 90*b* due to the distributed thrust action of the intermediate link 94 or feeler on the body 80. FIG. 4 shows the pressure force P which is exerted on the movable contact 22 when the latter is in a first rest position. The line of action of the force P is appreciably perpendicular to the intermediate link 94 of the spring 90, and urges the movable contact 22** counterclockwise to exert the contact pressure.

The handle 62 of the mechanism 58 is in the closed position, pressing up against the left-hand end of the aperture 64. The mechanism 58 with the spring 72 is charged, and the trip device 44 is inactive. The application point 103 of the force P is on the edge of the body 80.

Figure 7:
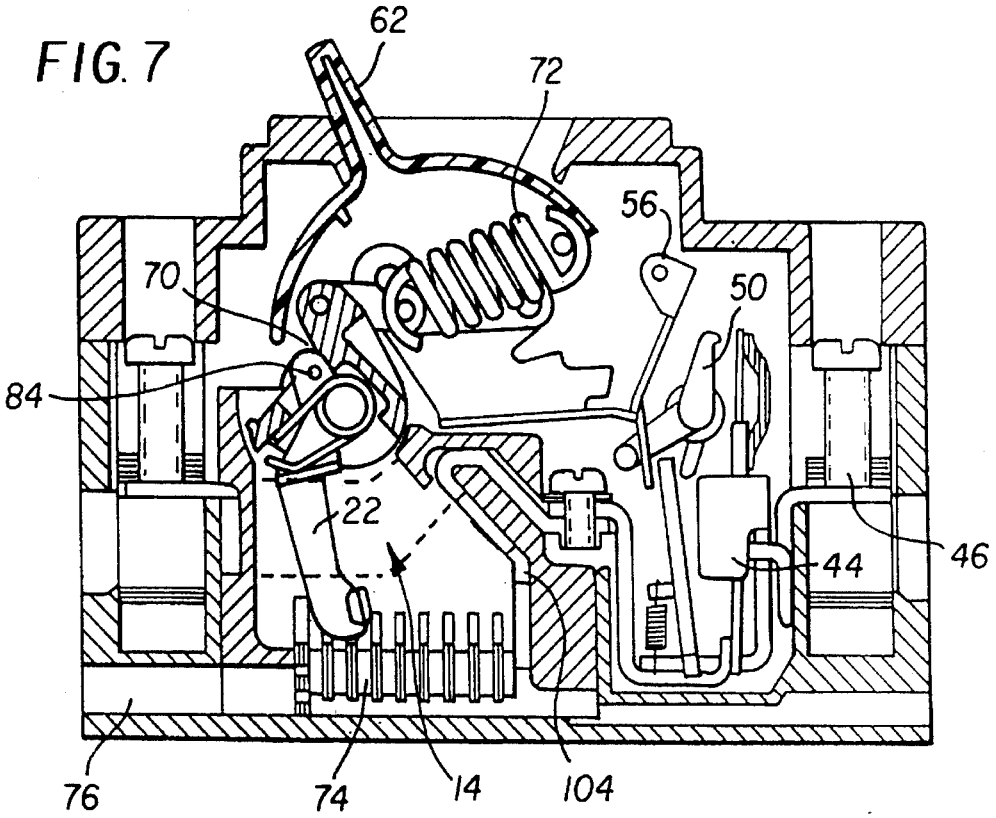
FIGS. 7 and 8 are identical views to FIG. 1, respectively at the beginning and end of the electrodynamic repulsion phase; and, FIG. 9 shows an identical view to FIG. 1 when manual opening of the circuit breaker is performed.

In FIG. 7, the occurrence of a short-circuit current in the pole causes an electrodynamic repulsion effect of the contacts, with high-speed movement of the movable contact 22, which pivots around its spindle 84, in the clockwise direction. The electrodynamic repulsion ensures high-speed opening of the contacts of the faulty pole, before mechanical operation of the operating mechanism 58. The spring 72 and toggle 60 remain immobile, as does the switching bar 70, whose position corresponds to that of FIG. 1. The arc remains anchored between the movable contact 22 and the stationary arcing horn 104, and is propelled in the direction of the deionization plates of the arc extinguishing chamber 74.

At the end of opening travel on repulsion (FIG. 8), the movable contact 22 is fully open and presses up against the wall of the cartridge 16. The arc is cooled by the plates of the chamber 74, and the trip device 44 begins controlling the tripping phase of the mechanism 58 (see arrows).

After tripping of the mechanism 58 (not represented in the figures), the latch 56 releases the toggle 60 causing expansion of the spring 72 and clockwise rotation of the bar 70, so as to confirm opening of the movable contact 22.

Figure 8:
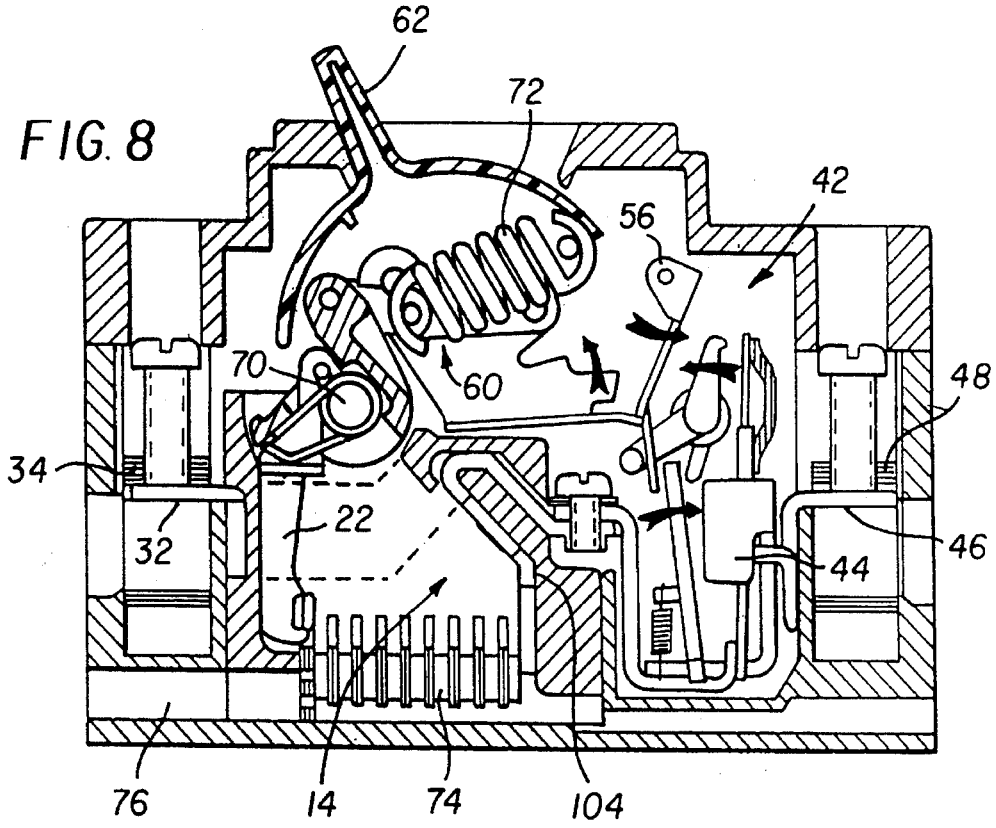

During the electrodynamic repulsion phases represented in FIGS. 7 and 8, it is imperative that the movable contact 22 does not reclose before operation of the bar 70 following tripping of the mechanism 58. The delay in drop-back of the movable contact 22 is obtained by means of the displacement of the application point 103 of the force P exerted on the body 80 when repulsion takes place.

In the repulsion position of FIG. 6, sliding of the flexible link 94 to the inside of the balancing slots 96, 98 modifies the location of the application point 103 of the force P exerted by the spring 90. The line of action of the force P passes close to the pivoting spindle 84 of the movable contact 22, which appreciably decreases the restoring torque to the closed position. This decrease of the restoring torque enables the drop-back of the movable contact 22 to be delayed before the bar 70 performs its operation.

The slots 96, 98 advantageously comprise latching surfaces shaped to temporarily block the movable contact 22 in the maximum repulsion position.

Figure 9:
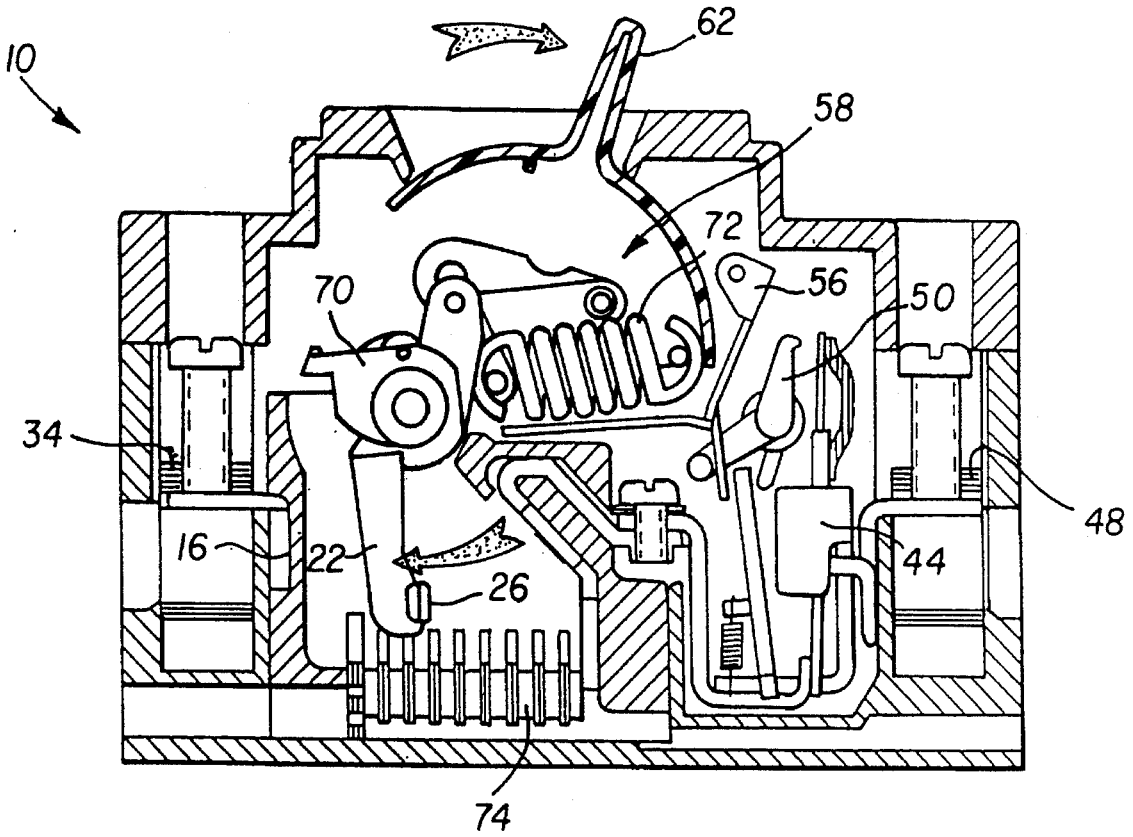

FIG. 9 shows a manual opening phase of the circuit breaker 10 by actuation of the handle 62 in the direction of the arrow. The mechanism 58 remains charged, and rotation of the bar 70 causes movement of the movable contact 22 to the open position as soon as the handle 62 has passed the intermediate opening dead-point position.

There is no electrodynamic repulsion of the contacts, and the application point 103 of the force P of the spring 90 corresponds to that of FIG. 4.

It is clear that the spirally-wound spring 90 can be replaced by any other type of spring.

I claim:

1. A multipole current-limiting circuit breaker, comprising:

a molded insulating case having a front panel and housing therein a plurality of poles, said front panel having an aperture;

a current interrupting device housed in the insulating case and including a stationary contact and a movable contact provided in each pole, and an arc extinguishing chamber positioned to extinguish arcs generated between the movable and stationary contacts;

an operating mechanism having a toggle biased via a spring device;

a trip device for activating the operating mechanism;

an operating handle connected to said operating mechanism and passing through the aperture in the front panel of the case;

a switching bar for supporting the movable contact of each of the poles, said switching bar comprising an insulating material and being mechanically coupled to said toggle which rotates the switching bar between open and closed positions, and having a recess for each movable contact which extends therethrough, each of said movable contacts being fork-shaped and including a common base supporting two contact arms, and a supporting shank extending from the common base, said common base having two balancing slots extending along a surface thereof, each of said movable contacts being pivotally secured to said switching bar via a spindle extending into said supporting shank such that the axis of rotation of each movable contact is eccentric to an axis of rotation of the switching bar, each of said movable contacts being adapted to pivot from a rest position to an active position by electrodynamic repulsion, such that the movable contact is separated from said stationary contact;

biasing means for providing a contact force for each of said movable contacts, and for slowing pivoting return movement of each movable contact to the rest position, said biasing means comprising a spirally-wound spring mounted to float in a respective recess of the insulating bar, said spirally-wound spring including a bearing arm which is slidable in the two balancing slots, whereby a contact point of the bearing arm and the two balancing slots varies, to change an application point of a biasing force exerted on each movable contact via the spirally-wound spring during movement of each movable contact from the rest position to the active position.

2. The circuit breaker of claim 1, wherein said spirally-wound spring includes two helicoidal coaxial windings which are interconnected by said bearing arm, said bearing arm including two joined strands which are respectively received in the two balancing slots.

3. The circuit breaker of claim 2, wherein said two joined strands are connected to each other via an upwardly-curved protruding portion.

4. The circuit breaker of claim 2, wherein said movable contacts and said spirally-wound springs are symmetrical with respect to a plane bisecting said supporting shank.

5. The circuit breaker of claim 1, wherein each of said two balancing slots includes a latching surface to block the movable contact in the active position.

6. The circuit breaker of claim 1, wherein each of said two balancing slots is V-shaped in cross-section.

* * * * *

UNITED STATES PATENT AND TRADEMARK OFFICE

CERTIFICATE OF CORRECTION

PATENT NO. : 5,469,121

DATED : November 21, 1995

INVENTOR(S) : Payet-Burin

It is certified that error appears in the above-indentified patent and that said Letters Patent is hereby corrected as shown below:

On the title page, item [54], line 1, change "MULTIPLE" to --MULTIPOLE--.

Signed and Sealed this

Twentieth Day of February, 1996

*Attest:*

Bruce Lehman

BRUCE LEHMAN

*Attesting Officer*

*Commissioner of Patents and Trademarks*